United States Patent [19]

Groutage et al.

[11] 4,108,400

[45] Aug. 22, 1978

[54] DUAL MODE GUIDANCE SYSTEM

[75] Inventors: Frederick D. Groutage, Bonita; Gabriel S. Borunda, San Diego, both of Calif.

[73] Assignee: The United States of America as represented by the Secretary of the Navy, Washington, D.C.

[21] Appl. No.: 710,965

[22] Filed: Aug. 2, 1976

[51] Int. Cl.[2] ..... F42B 15/10

[52] U.S. Cl. ..... 244/3.15; 244/3.16; 244/3.19

[58] Field of Search ..... 244/3.15, 3.16, 3.19

[56] References Cited

U.S. PATENT DOCUMENTS

| | | | |
|---|---|---|---|
| 3,064,924 | 11/1962 | Fairbanks | 244/3.16 |
| 3,165,749 | 1/1965 | Cushner | 244/3.19 |
| 3,743,215 | 7/1973 | Harris | 244/3.19 |
| 3,844,506 | 10/1974 | Stavis et al. | 244/3.19 |

*Primary Examiner*—Verlin R. Pendegrass

*Attorney, Agent, or Firm*—R. S. Sciascia; G. J. Rubens; H. Fendelman

[57] ABSTRACT

A dual mode missile guidance system employing a passive anti-radiation sensor for midcourse guidance and an alternate sensor for terminal guidance. A broadband, body mounted conformal antenna comprises the midcourse sensor, and the alternate sensor is mounted on a stabilized platform within the missile radome. Detected video guidance signals from the midcourse sensor are video processed and utilized to adjust the system phase shifters for null tracking as well as for driving the stabilized platform to keep the alternate sensor directed at the target. Upon the occurrence of a predetermined condition, a handover switch connects the detected video guidance signals provided by the alternate guidance sensor processor for video processing and for control of the stabilized platform. Auto pilot signals are derived from the rate gyros mounted on the stabilized platform.

9 Claims, 4 Drawing Figures

Fig. 1a
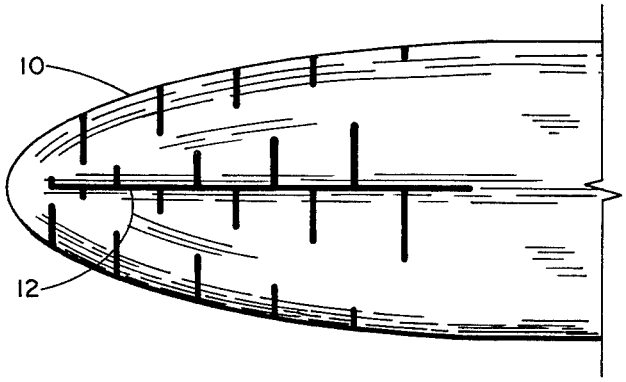
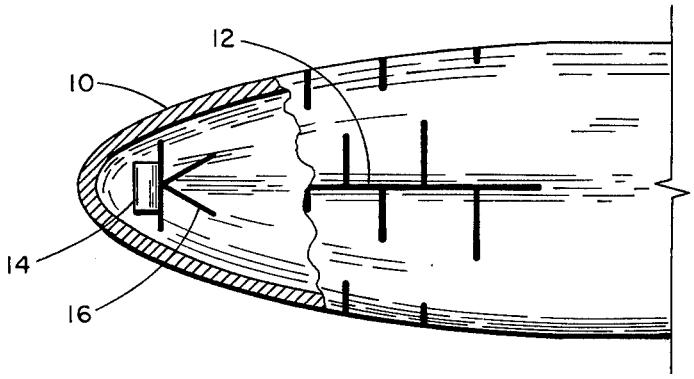
Fig. 1b
Fig. 1c
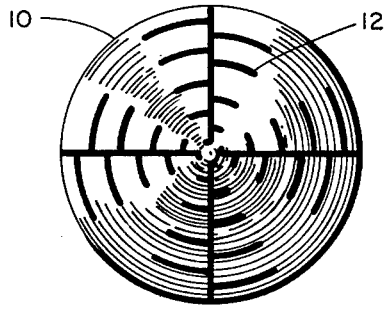

DUAL MODE GUIDANCE SYSTEM

BACKGROUND OF THE INVENTION

The present invention relates generally to improvements in weapon systems and more particularly to a guidance control system for guiding a missile toward a target. There are a wide variety of different principles utilized by missile guidance systems to determine the course to the target and to actuate an auto pilot in a manner to properly guide the missile. All of these methods involve principles well-known to those skilled in the art and need not be further described here. However, it is also well-known that the accuracy of the prior art systems is insufficient to insure the missiles hitting the target. Cumulative errors result in sufficient inaccuracies in both range and bearing to require some means of redirecting the missile onto the preselected target at the terminal point. Missile guidance schemes employing midcourse and terminal guidance techniques have been proposed in the past. However, insufficient room and the lack of a multi-mode guidance radome have prevented the development of multi-mode guidance missiles utilizing broadband passive anti-radiation homing as a principle mode of guidance.

SUMMARY OF THE INVENTION

The present invention relates to a multi-mode missile guidance scheme employing passive anti-radiation sensing for midcourse guidance and an alternate sensor such as active RF, passive infrared or electrical optical (E.O.)/T.V. guided sensing for terminal guidance. The passive anti-radiation guidance sensor for midcourse guidance utilizes conformal, fixed body mounted antennas to derive guidance information during the midcourse portion of the trajectory. Since the antenna for the anit-radiation sensor is part of the front end section of the missile excluding the extreme nose tip, the missile front end section is left vacant, thus allowing room for the alternate guidance mode and thereby alleviating the problem of two sensors with different and distinct radar requirements looking through the same radome. The unique combination of these sensors allows the terminal sensor to always be pointed at the target and thus maintains the target in its field of view such that guidance handover from the midcourse mode to the alternate, terminal mode can be accomplished without the alternate terminal guidance sensor going into the search mode. The auto pilot guidance commands are derived from the slaved alternate guidance sensor during midcourse such that body motion decoupled rate tracking information is obtained using the fixed body mounted midcourse guidance sensor.

Narrowband phase shifters are incorporated in a closed loop control system in the anti-radiation sensor mode. There is a phase shifter in each of the channels, at the intermediate frequency (IF), of the elevation and azimuth guidance planes. The phase differential in the channels of the elevation of azimuth planes is a function of the missile off-axis look angle. According to the present invention, the phase shifters are adjusted such that the phase differential between the two channels is zero, thereby effectuating null tracking. The phase shifter control voltage is monitored and utilized to train the stabilized platform on which the alternate sensor is mounted. By monitoring the output of the rate gyros on the stabilized platform, a measure of the line-of-sight rate from the missile to the target is obtained. This measure of the line-of-sight rate is used to derive steering commands for a missile employing proportional navigation. The inventive concept herein of training the stabilized platform of the alternate guidance mode with the phase shifter control voltage provides a very simple means of generating line-of-sight rate steering commands for proportional navigation as well as queuing the alternate mode guidance sensor to the target for guidance handoff and decoupling body motion from the missile steering commands as described above.

STATEMENT OF THE OBJECTS OF THE INVENTION

Accordingly, it is the primary object of the present invention to disclose a novel multi-mode missile guidance scheme.

It is an additional object of the present invention to disclose a multi-mode missile guidance scheme in which there is no radome problem since only one guidance sensor looks through a narrowband single guidance mode radome.

It is a further object of the present invention to disclose a novel scheme for missile guidance in which conformal, body mounted antennas allow room for an alternate guidance sensor to be located in the front end of a missile.

It is a still further object of the present invention to disclose a missile guidance scheme in which queuing of the alternate guidance sensor for terminal missile guidance handoff is accomplished.

It is another object of the present invention to disclose a novel missile guidance scheme in which line-of-sight rate proportional missile guidance is easily mechanized.

Another object of the present invention is to disclose a novel missile guidance scheme in which body motion decoupling is accomplished by the stabilized alternate mode guidance sensor.

Other objects, advantages and novel features of the invention will become apparent from the following detailed description of the invention when considered in conjunction with the accompanying drawings.

BRIEF DESCRIPTION OF THE DRAWINGS

FIG. 1*a* is an illustration of a suitable fixed body anti-radiation sensor antenna located on the missile skin.

FIG. 1*b* is a cut-away view of the missile radome depicting the stabilized platform and alternate sensor.

FIG. 1*c* is a front end view of the missile showing the anti-radiation sensor antenna.

DESCRIPTION OF THE PREFERRED EMBODIMENT

Figure 2:
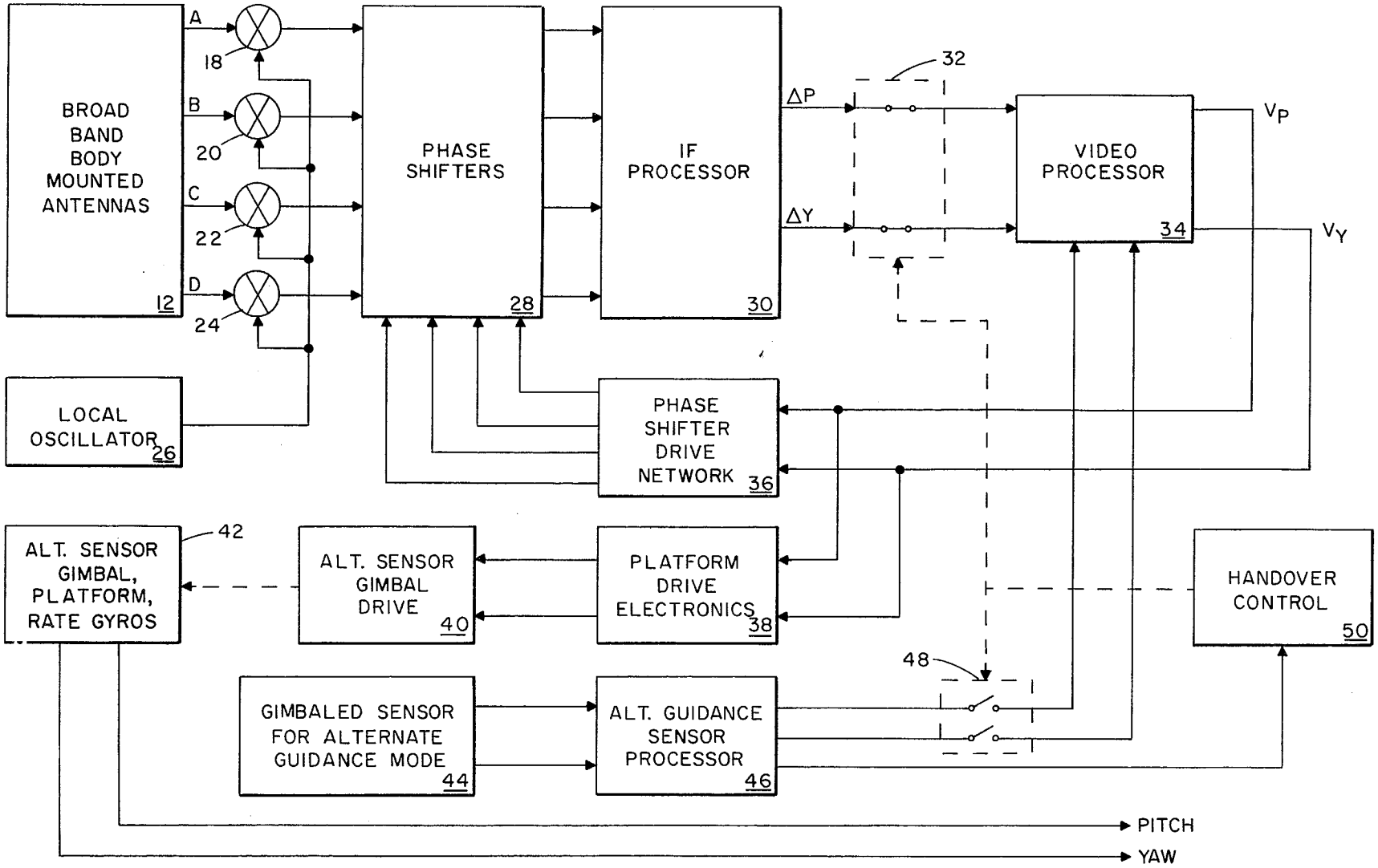
FIG. 2 is a network block diagram of the guidance system according to the present invention.

Referring now to FIGS. 1*a* and 1*b* there is illustrated a missile front end radome 10. The passive anti-radiation sensor antenna 12 is affixed to, cut or etched into the missile radome skin by any well-known technique and may comprise, for example, a broadband, log periodic antenna array as illustrated. The fixed body, conformal antenna 12 thus constitutes the radiation directional sensing portion of the anti-radiation sensor (ARS) for deriving missile guidance information from a source emanating RF energy. The antenna occupies the front end section of the missile and may exclude the extreme nose tip and in the illustrated configuration leaves the front end section of the missile vacant in order to allow room for another guidance mode to be located therewithin. It is noted that the missile front end radome 10 has been depicted as a hemispherical radome but it is to be understood that any other radome shape may be utilized in accordance with the type of alternate sensor mounted within.

Referring now to FIG. 1*b* there is illustrated a cutaway view depicting the alternate sensor 14 which is mounted on a stabilized platform 16 within the radome in a well-known manner. The stabilized platform 16 is mounted on and positioned by a gimbal mechanism (not shown) as is well-known. The alternate sensor 14 may comprise, for example, an active RF sensor, a passive anti-infrared sensor, a E.O./T.V. guided sensor or any other suitable alternate sensing device.

A functional block diagram showing the individual sub-system that makes up the guidance system of the present invention is illustrated in FIG. 2. The raw information from the broadband, conformal, body mounted antennas 12 is outputted on first and second azimuth channels A and B and first and second elevation channels C and D. This received RF information from the antenna system 12 is heterodyned down to an intermediate frequency range by four broadband mixers 18, 20, 22 and 24 which receive an input from local oscillator 26. The mixer outputs drive voltage controlled phase shifters 28. These phase shifters are narrow-band devices operating in the intermediate frequency range, the purpose of which is to introduce electrical phase shift into the guidance channels and to affect a phase tracking loop. As is well-known, a single phase shifter could be put in one of the two channels per guidance plane or a phase shifter could be put in each of the two channels per guidance plane. The phase differential between channels A and B can be made equal to zero, for example, by subtracting all of the phase out of one of the channels or by adjusting one half the total phase, with phase shifters operating in a push-pull mode, in each channel.

The outputs of the phase shifters 30 are connected to an IF processor network which, as is well-known, may include, for example, a phase detector for developing position signals in the form of change in pitch ($\Delta P$) and change in yaw ($\Delta Y$) signals. The output, then, of IF processor 30 is a video pulse train and constitutes the detected video guidance signals. This output is connected through switch means 32, to be described below, to the inputs of the video processor 34. The video processor 34 operates in a well-known manner by receiving the detected video guidance signals and sorting out extraneous pulses by discriminating in accordance with predetermined criteria to output d.c. voltages $V_P$ and $V_Y$. The outputs of the video processor 34 are fed to the phase shifter drive network 36 and to the inputs of the platform drive electronics 38 of a well-known design. The platform drive electronics network 38 controls the alternate sensor gimbal drive 40 which positions the alternate sensor gimbal, platform and rate gyros 42. The alternate sensor gimbal drive 40 may comprise a torque motor or hydraulic actuator as is well-known.

The operation of the guidance system thus far disclosed will now be described. The phase differential in each of the two channels of the elevation and azimuth planes is a function of the missile off-axis look angle. The phase shifters 28 are adjusted in a closed loop control scheme by the output of the phase shifter drive network 36 such that the phase differential between the two channels in each plane is zero, thus effectuating null tracking. The video processor 34 control voltages $V_P$ and $V_Y$ are monitored and used to train the stabilized platform 42 on which the alternate sensor is mounted. By monitoring the output of the rate gyros on the stabilized platform, a measure of the line-of-sight rate from missile to target is obtained. This measure of line-of-sight rate is used to derive the steering commands for a missile employing proportional navigation. Thus, the rate signals or steering commands from the rate gyros serve as the auto pilot drive signals in the form of pitch and yaw signals.

The remainder of the guidance system will now be described. The output of the gimballed sensor 44 for the alternate guidance mode is processed by the alternate guidance sensor processor 46 which outputs detected video guidance signals and is similar to the IF processor 30. The alternate guidance sensor processor 46 output is connected through switch means 48 to the input of the video processor 34. The switch means 32 and 48 are controlled by handover control means 50 which may comprise, for example, a threshold detector for determining when the signal-to-noise ratio of the input signals from the alternate guidance sensor processor 46 reaches a predetermined threshold. The switch means 32 and 48 are designed and arranged such that when the switches 32 are in the closed position, the switches 48 are in the open position and when the switches 32 are in the open position, the switches 48 are in the closed position. The handover control means actuates the switches 32 and 48 such that during the midcourse guidance control the switches 32 are closed and the switches 48 are opened and upon the occurrence of the predetermined signal to noise threshold level the handover control 50 opens the switches 32 and closes the switches 48. It may thus be appreciated that prior to the terminal guidance phase, the alternate guidance sensor platform 42 is slaved to be looking in the direction of the oncoming radiation as detected by the body mounted antenna system 12. During the terminal flight phase of the missile, switch means 48 is closed and the alternate guidance sensor 44 provides homing guidance commands to the platform drive electronics 38 through the alternate guidance sensor processor 46 and the video processor 34. The rate gyro outputs on the stabilized platform provide body motion decoupled line-of-sight rate tracking guidance commands to the missile auto pilot during both the midcourse and terminal flight phases.

A novel dual-mode missile guidance scheme has thus been disclosed in which the alternate guidance sensor always has the target in its field of view since the alternate guidance sensor is mounted on the stabilized platform that is slaved to be looking in the direction of the oncoming target radiation during midcourse guidance. The alternate guidance sensor thus does not have to go into a search mode to locate the target in its field of view at alternate guidance handover.

Obviously many modifications and variations of the present invention are possible in the light of the above teachings. It is therefore to be understood that within the scope of the appended claims the invention may be practiced otherwise than as specifically described.

What is claimed is:

1. A multimode missile guidance system comprising:

a missile radome;

an anti-radiation sensor mounted on said radome for outputting on first and second azimuth channels azimuth guidance plane signals and on first and second elevation channels elevation guidance plane signals;

a movable stabilized platform secured within said radome including drive means for positioning thereof;

an alternate mode guidance sensor mounted on said platform;

a first phase shifter means connected in at least one of said azimuth channels;

a second phase shifter means connected in at least one of said elevation channels;

a phase shifter drive network connected to said first and second phase shifter means;

an IF processor connected to the outputs of said first and second phase shifter means for developing detected video guidance signals;

video processor means connected to the output of said IF processor and to said phase shifter drive network for outputting d.c. pitch and yaw signals such that said phase shifter drive network drives said first and second phase shifter means such that the phase differential between said azimuth guidance plane signals on said first and second azimuth channels approaches zero and such that the phase differential between said elevation guidance plane signals on said first and second elevation channels approaches zero to effectuate null tracking;

a platform drive network connected to said video processor means for outputting position command signals to said movable platform drive means; and an alternate mode guidance sensor processor having an input connected to said alternate mode guidance sensor and an output connected to said video processor means for outputting alternate mode detected video guidance signals.

2. The system of claim 1 further comprising:

first switch means series connected between said IF processor and said video processor means and;

second switch means series connected between said alternate mode guidance sensor processor and said video processor means.

3. The system of claim 2 further comprising:

handover control means operably coupled to said first and second switch means for causing switching of said first and second switch means upon the occurrence of a predetermined condition.

4. The system of claim 3 wherein said second switch means is closed when said first switch means is open and said second switch means is open when said first switch means is closed.

5. The system of claim 4 wherein said handover control means receives information from said alternate mode guidance sensor processor.

6. The system of claim 5 wherein said alternate mode guidance sensor is an IR sensor.

7. The system of claim 5 wherein said alternate mode guidance sensor is an RF sensor.

8. The system of claim 5 wherein said alternate mode guidance sensor is a T.V. guided sensor.

9. The system of claim 5 wherein said anti-radiation sensor is a fixed body, conformal antenna.

* * * * *